US011694615B2

(12) United States Patent
Tang et al.

(10) Patent No.: US 11,694,615 B2
(45) **Date of Patent: *Jul. 4, 2023**

(54) COMPENSATION SYSTEMS AND METHODS FOR OLED DISPLAY DEGRADATION

(71) Applicant: Ignis Innovation Inc., Waterloo (CA)

(72) Inventors: Shuenn-Jiun Tang, Guelph (CA); Junhu He, Waterloo (CA); Tong Liu, Waterloo (CA); Gabriel Franklin Yano de Sousa, Waterloo (CA)

(73) Assignee: Ignis Innovation Inc., Road Town (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/592,554

(22) Filed: Feb. 4, 2022

(65) Prior Publication Data

US 2022/0157237 A1 May 19, 2022

Related U.S. Application Data

(63) Continuation of application No. 16/567,374, filed on Sep. 11, 2019, now Pat. No. 11,276,348, which is a continuation-in-part of application No. 16/515,211, filed on Jul. 18, 2019, now Pat. No. 11,276,347.

(60) Provisional application No. 62/890,173, filed on Aug. 22, 2019, provisional application No. 62/700,415, filed on Jul. 19, 2018.

(51) Int. Cl.
*G09G 3/3225* (2016.01)

(52) U.S. Cl.
CPC ..... *G09G 3/3225* (2013.01); *G09G 2320/029* (2013.01); *G09G 2320/0233* (2013.01); *G09G 2320/041* (2013.01); *G09G 2320/045* (2013.01); *G09G 2330/10* (2013.01)

(58) Field of Classification Search
CPC ..... G09G 3/3225; G09G 2320/0271; G09G 2320/0233; G09G 2320/029; G09G 2320/041; G09G 2320/045; G09G 2330/10
See application file for complete search history.

(56) References Cited

U.S. PATENT DOCUMENTS

2014/0111567 A1* 4/2014 Nathan ..... G09G 3/3241 345/694
2016/0104411 A1* 4/2016 Nathan ..... G09G 3/3283 345/77
2016/0307498 A1* 10/2016 Chaji ..... G09G 3/3291
2017/0243562 A1* 8/2017 Hu ..... G09G 5/10

* cited by examiner

*Primary Examiner* — Amare Mengistu
*Assistant Examiner* — Jennifer L Zubajlo
(74) *Attorney, Agent, or Firm* — Stratford Group Ltd.

(57) ABSTRACT

What is disclosed are systems and methods for compensating for display OLED degradation. Correction factors k for OLED degradation of each sub-pixel is modelled and tracked based on grey level, temperature, and time, and used to correct image data provided to an OLED display.

20 Claims, 3 Drawing Sheets

COMPENSATION SYSTEMS AND METHODS FOR OLED DISPLAY DEGRADATION

CROSS-REFERENCE TO RELATED APPLICATIONS

This application is a continuation of U.S. patent application Ser. No. 16/567,374, filed Sep. 11, 2019, now allowed, which is a continuation-in-part of and claims priority to U.S. patent application Ser. No. 16/515,211, filed Jul. 18, 2019, which claims priority from U.S. patent application Ser. No. 62/700,415 filed Jul. 19, 2018. This application also claims priority from U.S. patent application Ser. No. 62/890,173 filed Aug. 22, 2019.

FIELD OF THE INVENTION

The present disclosure relates to image correction for light emissive visual display technology, and particularly to organic light emitting device (OLED) degradation compensation systems and methods for correcting images of active matrix organic light emitting diode device (AMOLED) displays.

BRIEF SUMMARY

According to a first aspect, there is provided a method of compensating for degradation in pixels of a display panel module mounted in a host device, each pixel including a light-emitting device, the method comprising: during operation of the display panel module, sampling grey level data of image data for each pixel, and sampling temperature data corresponding to each pixel; determining an updated correction factor for each pixel as a function of the grey level data and the temperature data for each pixel; and applying the correction factor for each pixel to the image data for the pixel, generating corrected image data for display by the display panel module.

Some embodiments further provide for storing the updated correction factor in non-volatile memory either in the host device or the display panel module. In some embodiments, the updated correction factor is stored in the non-volatile memory each time the updated correction factor is determined. In some embodiments, the updated correction factor is stored in the non-volatile memory immediately prior to shut-down of the host device.

Some embodiments further provide for storing the updated correction factor for each sub-pixel in volatile memory either in the host device or the display panel module. In some embodiments, the updated correction factor for each sub-pixel is stored in a look-up table in volatile memory.

In some embodiments, the updated correction factor for each sub-pixel is further determined as a function of a sampling time period.

In some embodiments, the updated correction factor for each sub-pixel is determined as a sum of a product of a first function of the sampled grey level data, a second function of a sampling time period, and a third function of the sampled temperature data of each sub-pixel.

In some embodiments, the updated correction factor for each sub-pixel is determined with use of a look-up table, the sampled grey level data, a sampling time period, and the sampled temperature data.

According to another aspect there is provided a device comprising: a display panel module; an image data block; a host processing unit; and a compensation block.

The display panel module comprises: a display panel including a plurality of pixels, each pixel including a light-emitting device; a display processing unit; display non-volatile memory; and display volatile memory.

The image data block is for providing image data to the display panel.

The host processing unit includes: host non-volatile memory; and host volatile memory.

The host processing unit is configured for: storing, for each pixel, a correction factor representing a degradation of the pixel in the host non-volatile memory; during operation of the display panel, sampling grey level data of the image data received from the image block for each pixel, and temperature data corresponding to the pixel received from the display panel; and determining an updated correction factor for each pixel as a function of the sampled grey level data and temperature data for each pixel.

The compensation block is for applying the updated correction factor for each pixel to the image data for the pixel received from the image data block, and generating corrected image data for display by the display panel.

In some embodiments, the host non-volatile memory or the display non-volatile memory is further for storing the updated correction factor. In some embodiments, the host non-volatile memory or the display non-volatile memory is further for storing the updated correction factor each time the updated correction factor is determined. In some embodiments, the host non-volatile memory or the display non-volatile memory is further for storing the updated correction factor immediately prior to shut-down of the host device.

Some embodiments further provide for a host volatile memory or a display volatile memory for storing the updated correction factor for each sub-pixel. In some embodiments, the updated correction factor for each sub-pixel is stored in a look-up table in the host volatile memory or the display volatile memory.

In some embodiments, the processing unit determines the updated correction factor for each sub-pixel according to an OLED degradation model.

In some embodiments, the processing unit further determines the updated correction factor for each sub-pixel as a function of a sampling time period.

In some embodiments, the processing unit determines the updated correction factor for each sub-pixel as a sum of a product of a first function of the sampled grey level data, a second function of a sampling time period, and a third function of the sampled temperature data of each sub-pixel.

In some embodiments, the processing unit determines the updated correction factor for each sub-pixel with use of a look-up table, the sampled grey level data, a sampling time period, and the sampled temperature data.

In some embodiments, wherein the processing unit comprises a graphics processing unit (GPU) or a central processing unit (CPU) of the host device.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
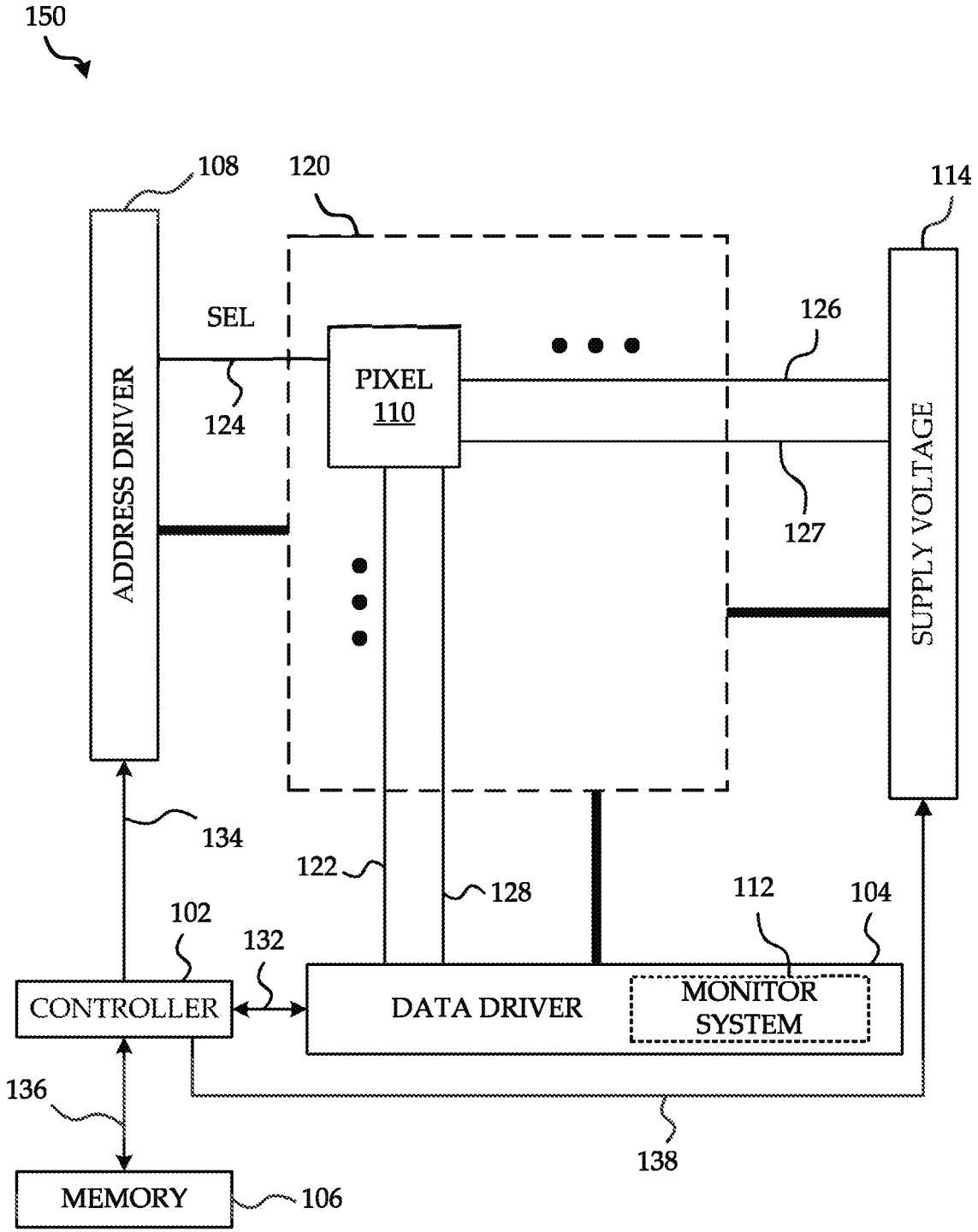
FIG. 1 illustrates an example display system which participates in and whose pixels are corrected by the degradation compensation systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

An OLED device is a Light Emitting Diode (LED) in which the emissive electroluminescent layer is a film of organic compound that emits light in response to an electric current. This layer of organic layers is situated between two electrodes; typically, at least one of these electrodes is transparent. Compared to conventional Liquid Crystal Displays (LCDs), Active Matrix Organic Light Emitting Device (AMOLED) displays offer lower power consumption, manufacturing flexibility, faster response time, larger viewing angles, higher contrast, lighter weight and amenability to flexible substrates. An AMOLED display works without a backlight because it emits visible light and each pixel consists of different colored OLEDs emitting light independently. The OLED panel can display deep black level and can be thinner than an LCD display.

Typically, LED and AMOLED displays require some form of image correction post fabrication. All LED and AMOLED displays, regardless of backplane technology, exhibit differences in luminance on a pixel to pixel basis, primarily as a result of process or construction inequalities, or from aging caused by operational use over time. Luminance non-uniformities in a display may also arise from natural differences in chemistry and performance from the LED and OLED materials themselves. These non-uniformities must be managed by the LED and AMOLED display electronics in order for the display device to attain commercially acceptable levels of performance for mass-market use.

To facilitate image correction, for a given display after singularization, methods such In-Pixel Compensation (IPC) or electrical measurement or a combination of both IPC compensation and electrical measurement, may also be used to acquire the correction data. The correction data is then stored on a Non-Volatile Memory (NVM) chip inside the display system and final product as initial correction data for later processing and updating as and when further degradation occurs.

While the embodiments described herein will be in the context of AMOLED displays it should be understood that the degradation correction systems and methods described herein are applicable to any other display comprising pixels which undergo degradation similar to that of OLEDs described below.

It should be understood that the embodiments described herein pertain to systems and methods of image correction and degradation compensation and do not limit the display technology underlying their operation and the operation of the displays in which they are implemented. The systems and methods described herein are applicable to any number of various types and implementations of various visual display technologies.

FIG. 1 is a diagram of an example display system 150 whose degradation is to be compensated and whose images are to be corrected with the systems and methods described further below in conjunction with an arrangement with a compensation system 200 of FIG. 2. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen and various subsets of its pixels define "display areas" which may be used for monitoring and managing display brightness. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices which may be subject to similar degradation, including current-driven light emitting devices. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display panel 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the supply voltage 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 12 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110. In some embodiments the temperature sensing circuitry of the display panel 120 measures temperature on a pixel-by-pixel basis, while in others it determines coarse local temperatures for a number of display areas, while in others, it determines a single global temperature of the display panel 120. In other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The controller 102 and memory 106 together or also in combination with a correction block (not shown in FIG. 1) use compensation data or correction data, in order to address and correct for the various defects, variations, and non-uniformities, existing at the time of fabrication, and defects suffered further from aging and deterioration after usage. In some embodiments, the correction data includes data for correcting the luminance of the pixels obtained through OLED degradation tracking and modelling using a compensation system as described below, while in other embodiments OLED degradation is applied to the image data prior to its being provided in memory 106. Some embodiments employ the monitoring system 112 to characterize the behavior of the pixels and to continue to monitor aging and deterioration as the display ages and to update the correction data to compensate for said aging and deterioration over time. Some embodiments the combine compensation performed by the monitoring system 112 and the controller 102 with the degradation compensation performed by the compensation system 200 described below while in other embodiments only the compensation system 200 performs any degradation compensation.

Figure 2:
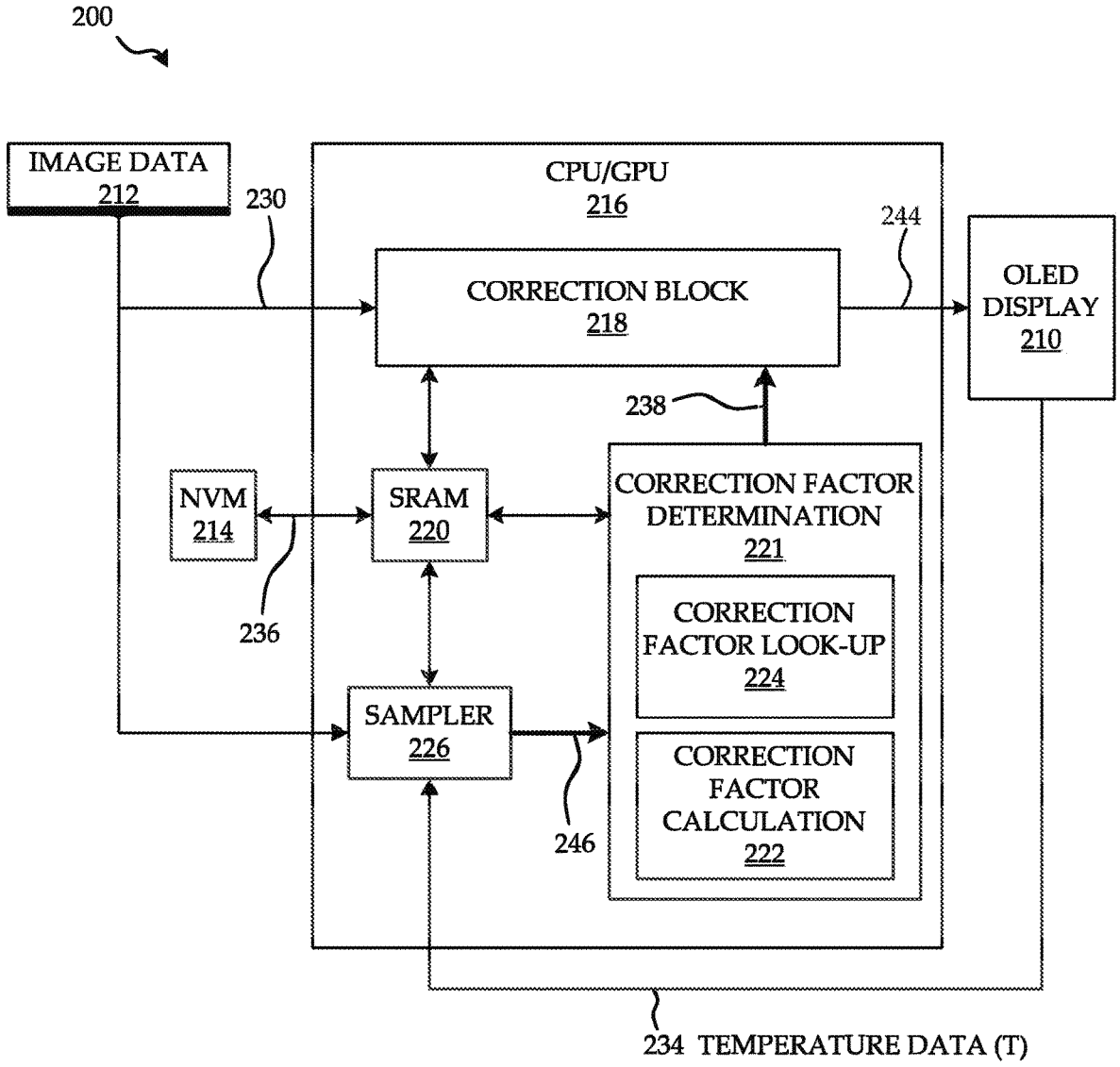
FIG. 2 is a schematic block diagram of an OLED degradation compensation system in accordance with an embodiment.

Referring to FIG. 2, a compensation system 200 for display degradation according to an embodiment will now be described.

The compensation system 200 includes the OLED display 210 which is to be corrected, and a central or graphics processing unit 216, as well as an image data block 212 which generates or receives the images to be displayed, and a non-volatile memory (NVM) 214 such as NAND flash memory. NVM 214 may be implemented in the non-volatile memory of a host device, in which the correction system 200 is implemented. The central or graphics processing unit 216 can comprise, for example, a CPU or a GPU of the host device or system in which the OLED display 210 is implemented. Such a host device or system could be, for example, a mobile device, phone, laptop, tablet, desktop, or TV. In another case, the processing unit 216 can be part of the display system and/or the controller 102 illustrated in FIG. 1, for example, integrated in a timing controller TCON. In some implementations, the OLED display 210 of FIG. 2 may correspond more or less to the display system 150 of FIG. 1 and includes similar components thereof In some embodiments, the processing unit 216 is external to the display system 150 illustrated in FIG. 1 and provides corrected image data 244 to memory 106 as the image data referred to hereinabove with respect to FIG. 1.

The processing unit 216 includes SRAM memory 220 as well as a number of functional blocks which may be implemented with software, firmware, or specialized hardware of the processing unit 216. These include a sampler 226, a correction block 218, and a correction factor determination unit 221 which includes a correction factor lookup unit 224 and a correction factor calculation unit 222. As illustrated in FIG. 2, each of the functional blocks of the processing unit 216 have access to SRAM 220 for storing and retrieving any of the data utilized in the compensation process, as and when needed.

Image data 230 which is generated or received at the image data block 212 and comprise images intended for display on the OLED display 210, are processed by the correction block 218 of the processing unit 216 utilizing correction factors 238 (described below) to generate corrected image data 244 for display by the OLED display 210. The corrected image data 244 compensates for OLED degradation of the sub-pixels of the OLED display 210.

Correction factors k for each sub-pixel of the OLED display 210 are stored in persistent storage such as non-volatile memory 214 in order to keep record of the degradation of the OLED display 210 over successive power up and shut down of the host device or system in which the compensation system 200 is implemented. In some embodiments, correction factors k are stored for each and every subpixel in a lookup table. This lookup table is stored in SRAM 220 of the processing unit 216 while the correction system 200 is in operation, and is also stored in the NVM 214 for persistent storage while correction system 200 is powered down. On power-up, the previously stored correction factors k are loaded from the NVM 214 to the SRAM 220 as starting k values which are periodically updated. In some embodiments, the device or system starts with correction factors k prepopulated from the factory in the NVM 214.

In order to track OLED degradation of each sub-pixel of the OLED display 210 in accordance with the model described below, while in operation, and sampler 226 of the processing unit 216 periodically samples grey scale or grey level data of the image data 230 from the image data block 212 intended for the sub-pixels of the OLED display 210. The sampler 226 also has access to temperature data (T) 234 originating from the OLED display 210 which it periodically samples. In some embodiments, this temperature data is provided for each and every subpixel, while in other embodiments the same temperature data (T) 226 applies to a plurality of the sub-pixels in each display area or, in the case where the temperature data (T) 234 is a single global temperature, applies to all of the sub-pixels. The sampler 226 provides sampled grey level and temperature data (sampled data 246) to the correction factor determination unit 221 which performs the necessary calculations to generate the correction factor k including integration or summation according to the model described below.

Once provided with the sampled data 248, the correction factor calculation unit 222 calculates the new correction factor k by obtaining the currently stored k factor and adding to it according to the model. As described below, the calculation of the new correction factor k depends upon the grey level data (GL), temperature data (T), and time (t), the last of which the correction factor calculation unit has independent access to. In some embodiments, the currently stored k factor for a particular sub-pixel is obtained from the look up table in SRAM 220 using the correction factor look-up unit 224. Once the new correction factor k is determined it is stored in SRAM 220, and also stored in NVM 214. In some embodiments, any updates to the correction factors in SRAM 220 is mirrored in the NVM 214 in order to keep the persistent correction factors current. In other embodiments the NVM 214 is updated with the current correction factors in SRAM 220 immediately prior to the host device or system being powered down.

The correction block 218 utilizes the correction factors k for every sub-pixel in its correction of the image data 230 into corrected image data 244 provided to the OLED display 210. In some embodiments the correction block 218 utilizes the correction factor look-up unit 224 to fetch the current correction factor k 238 for the sub-pixel whose data it is currently correcting. In other embodiments, the current correction factors are directly obtained from SRAM 220.

Figure 3:
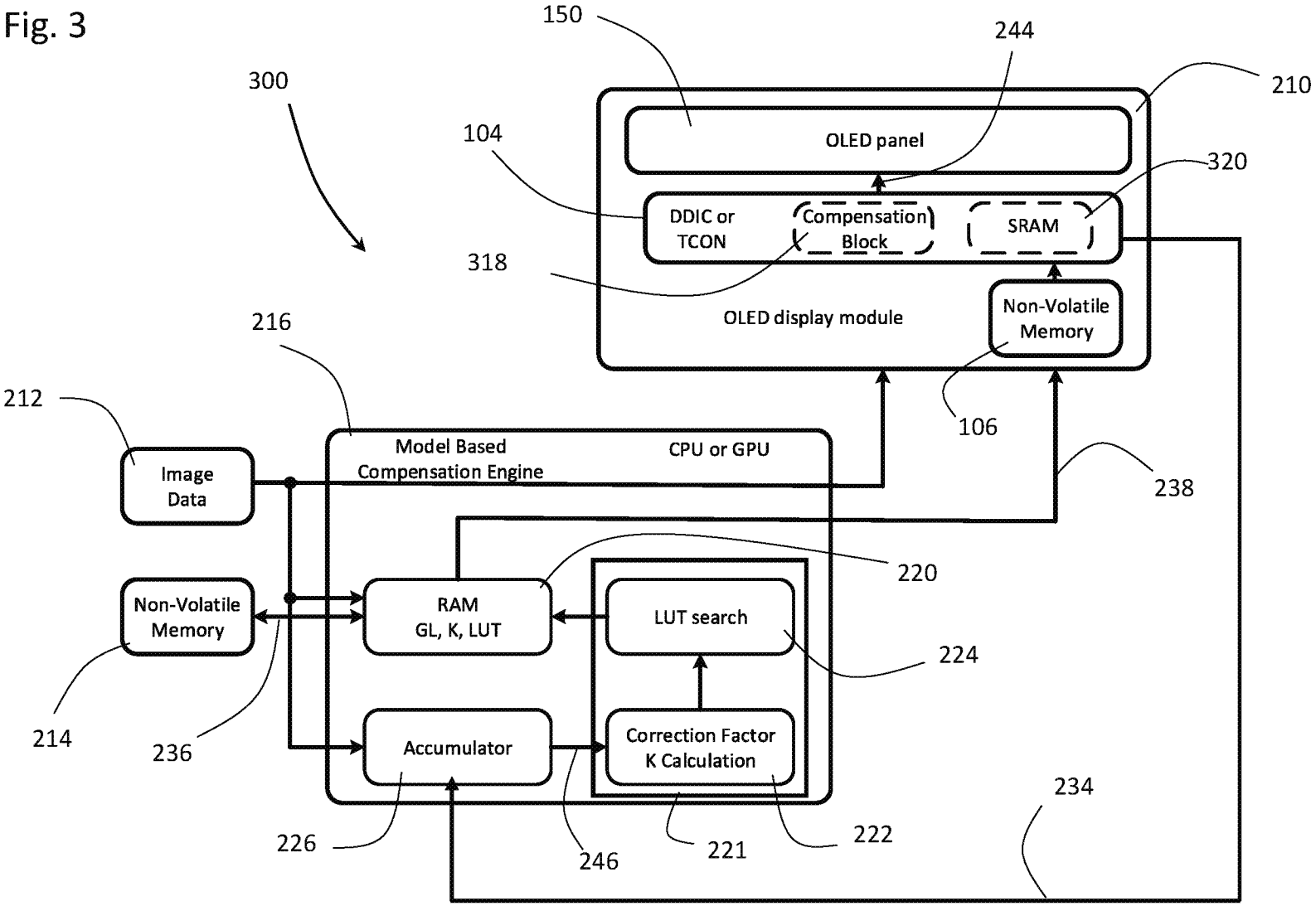
FIG. 3 is a schematic block diagram of an OLED degradation compensation system in accordance with another embodiment.

In an alternative embodiment, illustrated in FIG. 3, a compensation system 300 includes a correction block or compensation block 318 provided in the OLED display 210, e.g. in a display processing unit, such as the data driver 104 or the controller 102. Utilizing the correction block 318 on the OLED display 210 reduces the requirements on the host processing unit 216, and increases processing speeds.

Image data 230 which is generated or received at the image data block 212 and comprise images intended for display on the OLED display 210, are processed by the correction block 318 of the OLED display 210 utilizing correction factors 238 (described below) to generate corrected image data 244 for display by the OLED display 210. The corrected image data 244 compensates for OLED degradation of the sub-pixels of the OLED display 210.

Correction factors k for each sub-pixel of the OLED display 210 are stored in persistent storage such as non-volatile memory 106 or 214 in order to keep record of the degradation of the OLED display 210 over successive power up and shut down of the host device or system in which the compensation system 300 is implemented. In some embodiments, correction factors k are stored for each and every subpixel in a lookup table. This lookup table may be stored in SRAM 220 of the processing unit 216 and/or SRAM 320 of the OLED display 210 while the correction system 300 is in operation, and is also stored in the NVM 214 for persistent storage while correction system 300 or the OLED display 210 is powered down. On power-up, the previously stored correction factors k are loaded from the NVM 214 to the SRAM 220 and/or the SRAM 320 as starting k values which are periodically updated. In some embodiments, the device or system starts with correction factors k prepopulated from the factory in the NVM 214.

In order to track OLED degradation of each sub-pixel of the OLED display 210 in accordance with the model described below, while in operation, and sampler 226 of the processing unit 216 periodically samples grey scale or grey level data of the image data 230 from the image data block 212 intended for the sub-pixels of the OLED display 210. The sampler 226 also has access to temperature data (T) 234 originating from the OLED display 210 which it periodically samples. In some embodiments, this temperature data is provided for each and every subpixel, while in other embodiments the same temperature data (T) 226 applies to a plurality of the sub-pixels in each display area or, in the case where the temperature data (T) 234 is a single global temperature, applies to all of the sub-pixels. The sampler 226 provides sampled grey level and temperature data (sampled data 246) to the correction factor determination unit 221 which performs the necessary calculations to generate the correction factor k including integration or summation according to the model described below.

Once provided with the sampled data 248, the correction factor calculation unit 222 calculates the new correction factor k by obtaining the currently stored k factor and adding to it according to the model. As described below, the calculation of the new correction factor k depends upon the grey level data (GL), temperature data (T), and time (t), the last of which the correction factor calculation unit has independent access to. In some embodiments, the currently stored k factor for a particular sub-pixel is obtained from the look up table in the SRAM 220 and/or the SRAM 320 using the correction factor look-up unit 224. Once the new correction factor k is determined it is stored in SRAM 320, and also stored in NVM 214. In some embodiments, any updates to the correction factors in SRAM 220 and/or 320 is mirrored in the NVM 214 in order to keep the persistent correction factors current. In other embodiments the NVM 214 is updated with the current correction factors in SRAM 220 and/or 320 immediately prior to the host device or system being powered down.

The correction block 318 utilizes the correction factors k for every sub-pixel in its correction of the image data 230 into corrected image data 244 provided to the OLED display 150. In some embodiments the correction block 318 utilizes the correction factor look-up unit 224 to fetch the current correction factor k 238 for the sub-pixel whose data it is currently correcting. In other embodiments, the current correction factors are directly obtained from the SRAM 220 or the SRAM 320.

In some embodiments the correction block 218 or 318 utilizes the correction factor multiplicatively to generate the corrected image data 244. In some embodiments the corrected grey level for each sub-pixel in the corrected image data 244 is generated by the correction block 218 or 318, by multiplying the original grey level for each sub-pixel in the image data 230 by a function of the corresponding correction factor k of the sub-pixel. In some embodiments this function is non-linear.

In some embodiments, the correction factor look-up unit 224 includes functionality to look-up additional look-up tables for optimizing the calculation of the correction factors according to the model. In these embodiments, the functional dependence of the correction factor k upon the sampled data (grey level GL, temperature T, as well as time t) are stored in a look-up table to reduce processing computation of the correction factors k. In such an embodiment, the correction factor calculation unit 222 uses the correction factor look-up unit and the sampled grey level and temperature data, and its own tracking of time, to fetch the values of $F_1$, $F_2$, and $F_3$ (see below) from which it calculates the value of correction factor k, or to directly fetch the correction factor k.

In some embodiments, the frequency of access of the correction factors k by the correction block 218 or 318 exceeds the frequency of calculation and update of the correction factors k by the sampler 226 working in tandem with the correction factor determination unit 221. In such embodiments, the correction block 218 or 318 accesses the current correction factor k each time it is needed independently of when the correction factors are updated by the correction factor determination unit 221.

The correction factor determination unit 221 determines the correction factor k, according to an OLED degradation correction model in which the correction factor k is proportional to the overall sum of stress energy that an OLED endures during the time period from $t_i$ to $t_n$ as follows:

$$k \propto E_{OLED} \tag{1}$$

Here, the OLED energy $E_{OLED}$ is the accumulation of the product of the OLED voltage, $V_{OLED}$, and the OLED driving current, $I_{OLED}$:

$$E_{OLED}=\int_{t_n}^{t_n} P_{OLED}(t)dt=\int_{t_i}^{t_n}(I_{OLED}(t)\times V_{OLED}(t,T))dt \tag{2}$$

As illustrated in formula (2), $P_{OLED}$ represents the instantaneous power of the OLED and T represents the operating temperature of the OLED.

The OLED voltage $V_{OLED}$ can vary during the period as can the magnitude of the driving current $I_{OLED}$. An empirical model of equation (2) is provided such that the correction factor k is proportional to the accumulated stress Grey Level (GL) and time with mathematical functions as follows:

$$k \propto F(GL,t,T) \tag{3}$$

$$k \propto \Sigma F_1(GL)\times F_2(t)\times F_3(T) \tag{4}$$

Where, $F_1$ (GL), $F_2$ (t) and $F_3$ (T) represent the function of OLED driving current, the function of time and the function of temperature in which an OLED is operating respectively. In some embodiments, $F_1$ (GL) is of the form $A * (GL)^{\gamma}$, for example, where $\gamma$ is the intensity gamma curve for the OLED display, while in others $F_1$ (GL) is a polynomial of GL. In some embodiments, $F_2$ (t) is a polynomial of t. In some embodiments, $F_3$ (T) is of the form $C*T/T_0$, in others a polynomial of T, and in others a polynomial of $[-C*\exp(1/T-1/T_0)]$ where $T_0$ is a predetermined reference temperature.

In embodiments which utilize a look-up table for computation of the correction factor k or each of $F_1$, $F_2$, and $F_3$, the correction factor calculation unit 222 utilizes the correction factor look-up unit 224 to fetch the relevant value using GL, t, and T In other embodiments, the value of k is computed by integration or summation along with calculations of the product of the appropriate functional forms of $F_1$, $F_2$, and $F_3$.

Although the algorithms or processes described above have been described separately, it should be understood that any two or more of the algorithms or processes disclosed herein can be combined in any combination. Any of the methods, algorithms, implementations, or procedures described herein can include machine-readable instructions for execution by: (a) a processor, (b) a controller, and/or (c) any other suitable processing device. Any algorithm, software, or method disclosed herein can be embodied in software stored on a non-transitory tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it may be implemented by an application specific integrated circuit (ASIC), a programmable logic device (PLD), a field programmable logic device (FPLD), discrete logic, etc.). Also, some or all of the machine-readable instructions represented in process described herein can be implemented manually as opposed to automatically by a controller, processor, or similar computing device or machine. Further, although specific algorithms or processes have been described, persons of ordinary skill in the art will readily appreciate that many other methods of implementing the example machine readable instructions may alternatively be used. For example, the order of execution of the steps may be changed, and/or some of the blocks described may be changed, eliminated, or combined.

It should be noted that the algorithms illustrated and discussed herein as having various modules which perform particular functions and interact with one another. It should be understood that these modules are merely segregated based on their function for the sake of description and represent computer hardware and/or executable software code which is stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method of compensating for degradation in a plurality of pixels of a display panel of a display system, each pixel including a light-emitting device, the method comprising:

during operation of the display panel, sampling grey level data of image data intended for the plurality of pixels prior to being provided to the display panel, and sampling temperature data corresponding to the plurality of pixels;

determining updated correction factors for the plurality of pixels as a function of the grey level data and the temperature data for the plurality of pixels; and applying the updated correction factors for the plurality of pixels to the image data for the plurality of pixels, generating corrected image data for display by the display panel.

2. The method according to claim 1, wherein each updated correction factor is further determined as a function of a sampling time period.

3. The method according to claim 2, wherein each updated correction factor is determined as a sum of a product of a first function of the grey level data, a second function of the sampling time period, and a third function of the temperature data of each of the plurality of pixels.

4. The system according to claim 3, wherein the host processing unit is configured to determine each updated correction factor as a sum of a product of a first function of the grey level data, a second function of the sampling time period, and a third function of the temperature data for each of the plurality of pixels.

5. The system according to claim 3, wherein the host processing unit is configured to store each updated correction factor in a host non-volatile memory of the host processing unit.

6. The system according to claim 3, wherein the compensation block is provided in a display processing unit of a display panel module in which the display panel is comprised.

7. The system according to claim 2, wherein the host processing unit is further configured to determine each updated correction factor as a function of a sampling time period.

8. The method according to claim 1, further comprising storing, for each of the plurality of the pixels, an initial correction factor representing a degradation of each of the plurality of pixels in non-volatile memory.

9. The method according to claim 1, further comprising storing each updated correction factor in a non-volatile memory included in a display panel module in which the display panel is comprised.

10. The method according to claim 9, wherein the display panel module is comprised in a host device, and wherein each updated correction factor is stored in the non-volatile memory while the host device is powered down.

11. The method according to claim 9, further comprising storing each updated correction factor in a look-up table in volatile memory in the display module.

12. The method according to claim 9, further comprising storing each updated correction factor in a look-up table in volatile memory in a host device in which the display panel module is comprised.

13. The method according to claim 1, further comprising storing each updated correction factor in a non-volatile memory included in a host device in which the display panel is comprised.

14. The method according to claim 13, wherein the host device includes a processing unit configured to determine each updated correction factor.

15. The system according to claim 14, wherein the host processing unit is configured to store each updated correction factor in the display non-volatile memory each time each updated correction factor is determined.

16. The system according to claim 14, wherein the host processing unit is configured to store each updated correction factor in the display non-volatile memory while the display panel module is powered down.

17. The system according to claim 14, wherein the host processing unit is configured to store each updated correction factor in a look-up table in a display volatile memory of the display panel module.

18. The system according to claim 13, wherein the host processing unit is configured to store each updated correction factor in a display non-volatile memory of the display panel module.

19. The method according to claim 1, wherein each updated correction factor is stored in a non-volatile memory each time each updated correction factor is determined.

20. A system comprising:

a display panel including a plurality of pixels, each pixel including a light-emitting device;

a host processing unit configured for:

storing, for each of the plurality of pixels, a correction factor representing a degradation of the pixel in a memory of the host processing unit;

during operation of the display panel, sampling grey level data of image data intended for each of the plurality of pixels prior to being provided to the display panel, and temperature data corresponding to each of the plurality of pixels received from the display panel; and determining an updated correction factor for each of the plurality of pixels as a function of the sampled grey level data and temperature data for each of the plurality of pixels; and a compensation block for applying the updated correction factor for each of the plurality of pixels to the image data for each of the plurality of pixels, and generating corrected image data for display by the display panel.

* * * * *